US009687025B2

(12) United States Patent
Cyphert et al.

(10) Patent No.: US 9,687,025 B2
(45) Date of Patent: Jun. 27, 2017

(54) ELECTRONIC PIPE

(71) Applicant: Vapor Corp., Dania Beach, FL (US)

(72) Inventors: Gilbert Cyphert, Phoenix, AZ (US); Xuandong Huang, Guanghan (CN); Edwin Balder, Mesa, AZ (US)

(73) Assignee: Healthier Choices Managment Corp., Hollywood, FL (US)

( * ) Notice: Subject to any disclaimer, the term of this patent is extended or adjusted under 35 U.S.C. 154(b) by 659 days.

(21) Appl. No.: 13/987,851

(22) Filed: Sep. 9, 2013

(65) Prior Publication Data

US 2014/0069444 A1 Mar. 13, 2014

Related U.S. Application Data

(60) Provisional application No. 61/743,720, filed on Sep. 10, 2012.

(51) Int. Cl.
*A24F 47/00* (2006.01)
*A24F 1/00* (2006.01)

(52) U.S. Cl.
CPC ..... *A24F 1/00* (2013.01); *A24F 47/008* (2013.01)

(58) Field of Classification Search
CPC ..... A61M 15/06; A24F 47/00
See application file for complete search history.

(56) References Cited

U.S. PATENT DOCUMENTS 6,196,218 B1 * 3/2001 Voges ..... A24F 47/002 128/200.14
7,832,410 B2 11/2010 Hon
2008/0092912 A1 * 4/2008 Robinson ..... A24F 47/008 131/200
2009/0095287 A1 * 4/2009 Emarlou ..... A61M 11/041 128/200.14
2012/0199146 A1 * 8/2012 Marangos ..... A24F 47/008 131/328
2013/0220315 A1 * 8/2013 Conley ..... A61M 11/042 128/202.21

FOREIGN PATENT DOCUMENTS

CN 102423145 4/2012

* cited by examiner

*Primary Examiner* — Cynthia Szewczyk
(74) *Attorney, Agent, or Firm* — Geoffrey A. Lottenberg; Lewis Brisbois Bisgaard & Smith LLP

(57) ABSTRACT

An electronic pipe is provided. The electronic pipe includes a first pipe section having an electronic module and a first connector element that communicates with the electronic module. A second pipe section is structured to be removeably attachable to the first pipe section, the second pipe section including a combustible material reservoir having a passageway that communicates with a mouthpiece receiver, with an aperture located on a surface of the second pipe section, the aperture communicating with the combustible material reservoir so that a fluid exterior to the electronic pipe can pass into the aperture, through the combustible material reservoir and into the passageway that communicates with the mouthpiece receiver and a second connector element structured to removeably couple to the first connector element, with both connector elements structured to transmit an electric current from the battery to a heating element located within the combustible material reservoir.

10 Claims, 4 Drawing Sheets

ELECTRONIC PIPE

Priority is claimed to U.S. provisional patent application Ser. No. 61/743,720, filed Sep. 10, 2012, entitled: "Electronic Pipe," which is referred to and incorporated herein in its entirety by this reference.

FIELD OF THE INVENTION

The present invention relates to an electronic pipe, in particular to an electronic pipe that includes removable components.

BACKGROUND OF THE INVENTION

Despite the fact that "smoking is harmful to your health", the number of smokers worldwide is up to 1 billion, and the number is increasing every year. In 2003, the World Health Organization (WHO) concluded a global Framework Convention on Tobacco Control. According to the statistical data from WHO, about 4.9 million people die of diseases caused by smoking each year. Although smoking may cause serious respiratory diseases and cancer, it remains extremely difficult for smokers to quit smoking.

The active ingredient in a cigarette or pipe is nicotine. During smoking, nicotine, along with tar aerosol droplets produced in the cigarette when it burns, enters a smoker's alveolus and is rapidly absorbed. After being absorbed into the blood of a smoker, nicotine then produces its effect on the receptors of the smoker's central nervous system, which makes the smoker relax and enjoy an inebriety similar to that produced by an exhilarant.

Nicotine is a kind of alkaloid with a low molecular weight and its half-life in blood is quite short. The major harmful substance in tobacco is tar, which is composed of thousands of ingredients, tens of which are carcinogenic substances. It has been proven that passive smoking can be more harmful to non-smokers than smoking is to the smoker.

Some cigarette and pipe substitutes containing only nicotine without tar have been proposed, many of them, such as the "nicotine patch," "nicotine mouthwash," "nicotine chewing gum," "nicotine drinks" etc., are made of pure nicotine. Although these cigarette and pipe substitutes are free from tar, their major disadvantage is that an effective peak concentration of nicotine cannot be reached in the blood of a smoker due to slow absorption of the nicotine. In addition, these cigarette and pipe substitutes cannot satisfy the habitual smoking actions of a smoker, for example, the inhaling action and the physical manipulation of the cigarette or pipe itself.

Therefore, there remains a need to overcome one or more of the limitations in the above-described, existing art. The discussion of the background to the invention included herein is included to explain the context of the invention. This is not to be taken as an admission that any of the material referred to was published, known, or part of the common general knowledge at the priority date of the claims.

It will be recognized that some or all of the Figures are schematic representations for purposes of illustration and do not necessarily depict the actual relative sizes or locations of the elements shown. The Figures are provided for the purpose of illustrating one or more embodiments of the invention with the explicit understanding that they will not be used to limit the scope or the meaning of the claims.

DETAILED DESCRIPTION OF THE PREFERRED EMBODIMENTS

In the following description, for the purposes of explanation, numerous specific details are set forth in order to provide a thorough understanding of the electronic pipe of the present invention. It will be apparent, however, to one skilled in the art that the electronic pipe may be practiced without some of these specific details. Throughout this description, the embodiments and examples shown should be considered as exemplars, rather than as limitations on the electronic pipe. That is, the following description provides examples, and the accompanying drawings show various examples for the purposes of illustration. However, these examples should not be construed in a limiting sense as they are merely intended to provide examples of the electronic pipe rather than to provide an exhaustive list of all possible implementations of the electronic pipe.

Specific embodiments of the invention will now be further described by the following, non-limiting examples which will serve to illustrate various features. The examples are intended merely to facilitate an understanding of ways in which the invention may be practiced and to further enable those of skill in the art to practice the invention. Accordingly, the examples should not be construed as limiting the scope of the invention. In addition, reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner in one or more embodiments.

Figure 1:
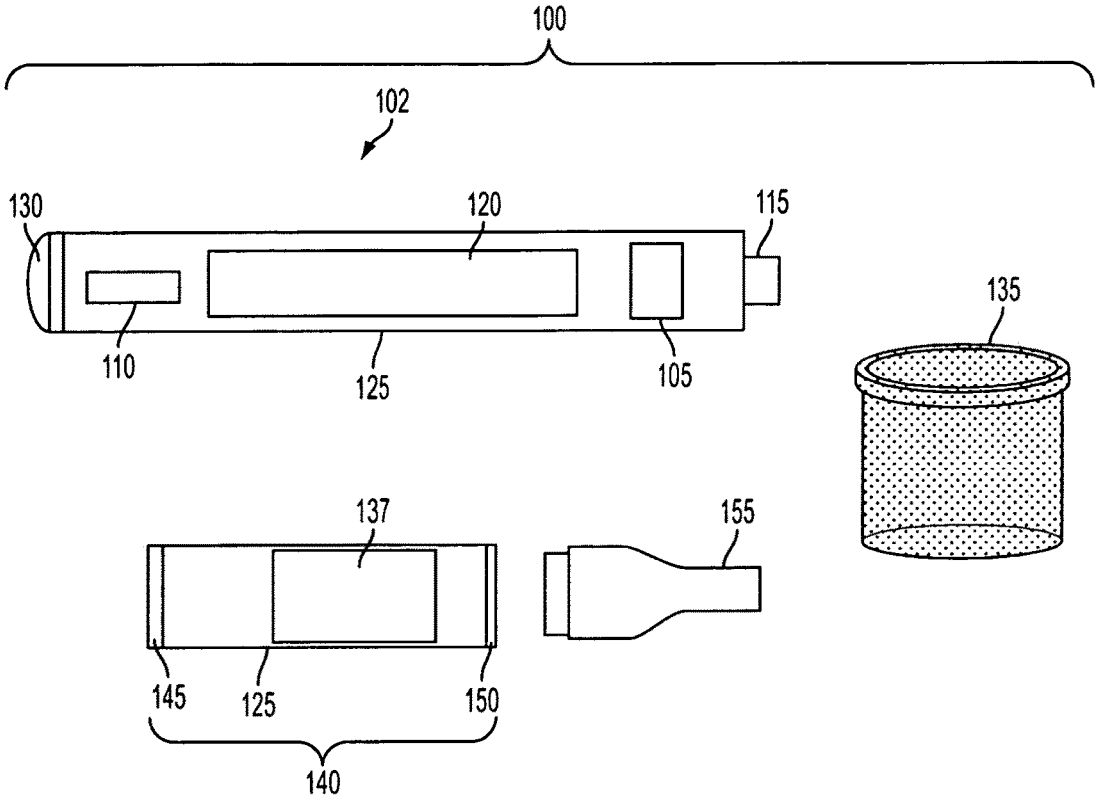
FIG. 1 is a view of a first embodiment of an electronic pipe embodying the principals of the invention.
Figure 2:
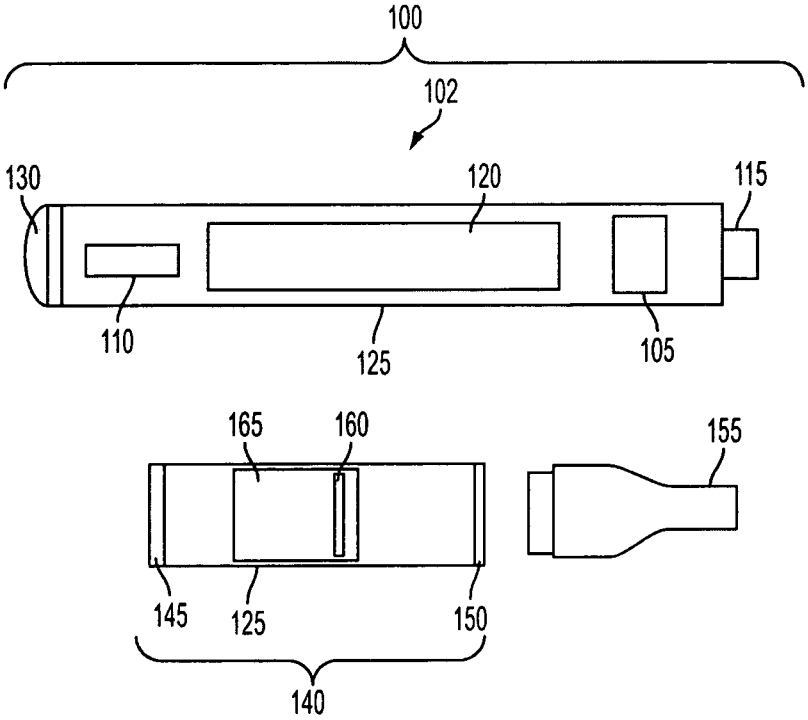
FIG. 2 is a view of a second embodiment of an electronic pipe embodying the principals of the invention.
Figure 3:
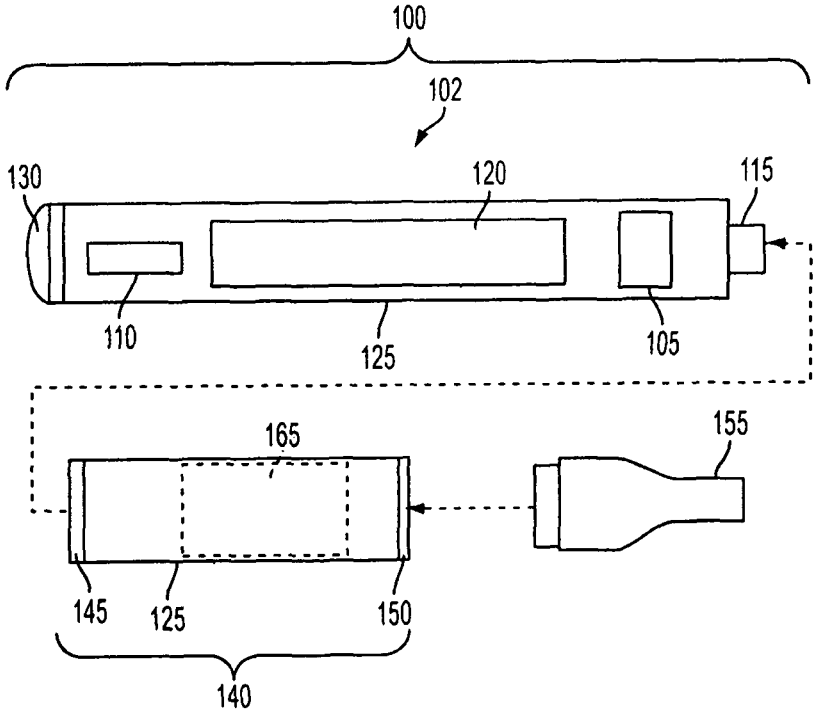
FIG. 3 is a view of a third embodiment of an electronic pipe embodying the principals of the invention.

Referring now to FIGS. 1-3, an electronic pipe 100 is illustrated. As shown in the figures, a first pipe section 102 includes a printed circuit board, or an integrated circuit, or a memory module encoded with a program (with the integrated circuit or the memory module possibly mounted on a printed circuit board) 105 located within the first pipe section 102. The printed circuit board 105 communicates with a liquid crystal display (LCD) 110 located on the first pipe section 102 so that the LCD is visible to a user. The LCD display 110 communicates with the printed circuit board 105 and a charging head 115 in the form of a male USB jack or outlet that enables the rechargeable battery 120 to be charged. In one embodiment, the rechargeable battery 120 is located within the first pipe section 102. It will be appreciated that other types of jacks, or charging heads 115 may be employed. Also, the rechargeable battery 120 may be a lithium battery or any other type of rechargeable battery.

The first pipe section includes an outer shell 125 comprised of stainless steel, but it will be appreciated that other materials may be employed, such as aluminum alloys, plastics, and a combination of the above materials. The cross-section shape of the outer shell 125 may be cylindrical, square, ellipsoidal or other desired shapes.

A light emitting diode (LED) tip indicator 130 is located on a distal end of the outer shell 125 of the first pipe section 102. Adjacent to the printed circuit board 105 is a depressible button (not shown). When pressing the button, the rechargeable battery 120 supplies power to several elements of the electronic pipe 100 as discussed below. This includes providing power to a heating wire 160, a heating net 135, the LED tip indicator 130, and other components in the electronic pipe 100, as required.

As shown in FIG. 1, a heating net 135 is provided for holding and burning a combustible material such as tobacco. Once filled with tobacco, the heating net 135 is set inside a heating net receiver 137 that is located in a second pipe section 140 that is detachable and re-attachable from the first pipe section 102. The second pipe section 140 includes a connector 145 at one end that enables the second pipe section 140 to be removeably attachable to the charging head 115. Once connected to the charging head 115, the second pipe section 140 receives electricity from the rechargeable battery 120 to thereby heat the heating net 135. Thus, in one embodiment, the connector 145 is a matching female USB element that mates to the male USB element comprising the charging head 115.

The second pipe section 140 includes an outer shell 125 like the first pipe section 102 of the electronic pipe 100, with the outer shell 125 comprised of stainless steel, but it will be appreciated that other materials may be employed, such as aluminum alloys, plastics, and a combination of the above materials. The cross-section shape of the outer shell 125 may be cylindrical, square, ellipsoidal or other desired shapes.

The second pipe section 140 also includes a mouthpiece receiver 150 that is sized to removeably receive a mouthpiece 155 that is intended for insertion into a user's mouth.

The first embodiment of the electronic pipe 100 illustrated in FIG. 1 includes several features. For example, the battery 120 is rechargeable and can be plugged into a USB or wall adaptor for charging. Also, the printed circuit board 105 includes a locking capability. When the pressable button (not shown) is pressed 3 times within 2 seconds, the rechargeable battery 120 is locked (i.e., power is unavailable to any component of the electronic pipe 100). When the pressable button (not shown) is pressed 3 times within 2 seconds, again, the rechargeable battery 120 is unlocked. This safety feature ensures that the electronic pipe 100 will not begin heating the heating net 135 when the electronic pipe 100 is located in a user's pocket or when not in use.

In addition, the printed circuit board 105 has a counting function which counts how many times a user presses the pressable button, and the count is displayed on the LCD display 110. This function is reset when the rechargeable battery 120 is recharged through plugging the USB charging head into a power source. The LCD display 110 shows the present charged state of the rechargeable battery 120. For example, when the rechargeable battery 120 is fully charged, the LCD display 110 shows 4 lines. When the rechargeable battery 120 needs to be charged, no lines are displayed on the LCD display 110. In this state, the LED tip 130 flashes 10 times to alert the user that the rechargeable battery 120 needs to be charged.

Before using the electronic pipe 100 the user loads tobacco, or any type of combustible material desired, into the heating net 135, then inserts the heating net 135 into the heating net receiver 137. Then the mouthpiece 155 is installed onto the mouthpiece receiver 150. After doing so, the connector 145 of the detachable component 140 is screwed or inserted over or into the charging head 115. Once connected to the charging head 115, the heating net receiver 137, or a heating wire 160 (shown in FIG. 2) located in the heating wire receiver 137 receives electricity from the rechargeable battery 120 to thereby heat the heating net 135, initiate a combustion reaction in the heating net, and ignite the combustible material located in the heating net 135. Alternatively, the removable heating net 135 may remain inside the heating net receiver 137 and be loaded with tobacco in place while the detachable component 140 is connected.

After assembling the electronic pipe 100, the user may press the pressable button (not shown) that is on, or adjacent to the printed circuit board 105. When pressing the pressable button, the LED tip 130 illuminates, and/or alternatively, the LCD display 110 may also illuminate, thereby indicating that the rechargeable battery 120 is supplying power to the heating net receiver 137. The tobacco, or other ignitable material therein will then be ignited.

Referring now to FIG. 2, a second embodiment electronic pipe 100 is illustrated. The elements and reference numbers discussed above in connection with the embodiment illustrated in FIG. 1 apply to the embodiment illustrated in FIG. 2. Similar to the embodiment illustrated in FIG. 1, a first pipe section 102 includes a printed circuit board, or an integrated circuit, or a memory module encoded with a program (with the integrated circuit or the memory module possibly mounted on a printed circuit board) 105 located within the first pipe section 102. The printed circuit board 105 communicates with a liquid crystal display (LCD) 110 located on the first pipe section 102 so that the LCD is visible to a user. The LCD display 110 communicates with the printed circuit board 105 and a charging head 115 in the form of a male USB jack or outlet that enables the rechargeable battery 120 to be charged. In one embodiment, the rechargeable battery 120 is located within the first pipe section 102. It will be appreciated that other types of jacks, or charging heads 115 may be employed. Also, the rechargeable battery 120 may be a lithium battery or any other type of rechargeable battery.

The electronic pipe 100 shown in FIG. 2 includes an outer shell 3 comprised of stainless steel, but it will be appreciated that other materials may be employed, such as aluminum alloys, plastics, and a combination of the above materials. Again, similar to the embodiment illustrated in FIG. 1, a light emitting diode (LED) tip indicator 130 is located on a distal end of the outer shell 125 of the first pipe section 102. Adjacent to the printed circuit board 105 is a depressible button (not shown). When pressing the button, the rechargeable battery 120 supplies power to several elements of the electronic pipe 100 as discussed below. This includes providing power to a heating net 135, the LED tip indicator 130, and other components in the electronic pipe 100, as required.

In the embodiment illustrated in FIG. 2, a heating wire 160 is employed for heating the tobacco, or any other desired combustible material. The heating wire 160 is designed to heat to a temperature sufficient to ignite a combustible material that is placed in the combustible material reservoir 165 when an electric current is applied to the heating wire 160. The heating wire 160 may be constructed of titanium, tungsten, or other materials. The combustible material reservoir 165 may be constructed of a ceramic material, brass, another type of metal or aluminum alloy, or any other type of suitable material. In one embodiment the heating wire 160 may be partially, or completely covered by a protective element (not shown) to protect the heating wire 160 from the combustible material. For example, a heat resistant screen (not shown) may be placed around portions, or all of, the heating wire 160.

In addition, a filter (not shown) designed to minimize the passage of particulate matter to the mouthpiece 155 may be included in the both of the embodiments illustrated in FIGS. 1 and 2. For example, referring to FIG. 2, the filter may be located between the mouthpiece receiver 150 and the combustible material reservoir 165, or it may be located between the mouthpiece 155 and the mouthpiece receiver 150.

The heating wire 160 is located in a second pipe section 140 that is detachable and re-attachable from the first pipe section 102. The second pipe section 140 includes a connector 145 at one end that enables the second pipe section 140 to be removeably attachable to the charging head 115. Once connected to the charging head 115, the second pipe section 140 receives electricity from the rechargeable battery 120 to thereby heat the heating wire 160. Thus, in one embodiment, the connector 145 is a matching female USB element that mates to the male USB element comprising the charging head 115.

Like the embodiment of FIG. 1, the second pipe section 140 also includes a mouthpiece receiver 150 that is sized to removeably receive a mouthpiece 155 that is intended for insertion into a user's mouth. The second embodiment of the electronic pipe 100 illustrated in FIG. 2 includes several features. For example, the battery 120 is rechargeable and can be plugged into a USB or wall adaptor for charging. The printed circuit board 105 includes a locking capability. When the pressable button (not shown) is pressed 3 times within 2 seconds, the rechargeable battery 120 is locked (i.e., power is unavailable to any component of the electronic pipe 100). When the pressable button (not shown) is pressed 3 times within 2 seconds, again, the rechargeable battery 120 is unlocked. This safety feature ensures that the electronic pipe 100 will not begin heating the heating net 135 when the electronic pipe 100 is located in a user's pocket or when not in use.

In addition, the printed circuit board 105 has a counting function which counts how many times a user presses the pressable button, and the count is displayed on the LCD display 110. This function is reset when the rechargeable battery 120 is recharged through plugging the USB charging head into a power source. The LCD display 110 shows the present charged state of the rechargeable battery 120. For example, when the rechargeable battery 120 is fully charged, the LCD display 110 shows 4 lines. When the rechargeable battery 120 needs to be charged, no lines are displayed on the LCD display 110. In this state, the LED tip 130 flashes 10 times to alert the user that the rechargeable battery 120 needs to be charged.

Before using the electronic pipe 100 the user loads tobacco, or any type of combustible material desired, into the combustible material reservoir 165 that includes the heating wire 160 mounted within the combustible material reservoir 165. Then the mouthpiece 155 is installed onto the mouthpiece receiver 150. After doing so, the connector 145 of the detachable component 140 is screwed or inserted over or into the charging head 115. Once connected to the charging head 115, the heating wire 160 receives electricity from the rechargeable battery 120 to thereby heat the heating wire 160, initiate a combustion reaction in the combustible material reservoir 165, and ignite the combustible material located in the combustible material reservoir 165.

After assembling the electronic pipe 100, the user may press the pressable button (not shown) that is on, or adjacent to the printed circuit board 105. When pressing the pressable button, the LED tip 130 illuminates, and/or alternatively, the LCD display 110 may also illuminate, thereby indicating that the rechargeable battery 120 is supplying power to the heating net receiver 137. The tobacco, or other ignitable material therein will then be ignited.

On feature of the second embodiment electronic pipe 100 illustrated in FIG. 2, the user simply has to load tobacco, or any other combustible material inside the combustible material reservoir 165, which eliminates the step of inserting the heating net 135, as required in the first embodiment illustrated in FIG. 1.

The printed circuit board, or chip 105 may comprise an electronic assembly that allows communication between the various components discussed above. For example, in one embodiment, the printed circuit board, or chip 105 may comprise an embedded data processor connected via an internal bus to a read only memory containing the executable code for causing the microprocessor to perform the functions described herein. In another embodiment, the printed circuit board, or chip may comprise one or more electronic circuits that employ one or more switches to perform the functions described herein.

Referring now to FIG. 3, a third embodiment electronic pipe 100 is illustrated. The features, elements and reference numbers discussed above in connection with FIGS. 1 and 2 apply to the embodiment illustrated in FIG. 3. As shown in FIG. 3, the combustible material reservoir 165 is located within the second pipe section 140. That is, in one embodiment, the second pipe section 140 has a circular cross-section, with an aperture, or opening at the mouthpiece receiver 150 sized to receive both the mouthpiece 155 and a combustible material that is placed into the second pipe section 140 before the mouthpiece 155 is placed over the mouthpiece receiver 150. In this embodiment, only a small hole, or aperture (not shown) is located in the second pipe section 140 so that air can be provided to the combustible material reservoir 165, which is positioned entirely within the second pipe section 140.

One feature of this embodiment is that the combustible material cannot "spill" from an exterior opening. The only way to insert or remove the combustible material is to remove the mouthpiece 155, and access the combustible material reservoir 135 from the opening located at the mouthpiece receiver 150.

In all of the embodiments illustrated in FIGS. 1-3, a passageway, to permit air to flow between the mouthpiece receiver 150 and the heating net receiver 137 (in FIG. 1) or the combustible material reservoir 165 (in FIGS. 2-3) is located within the second pipe section 140.

Other embodiments of the electronic pipe disclosed above may include features disclosed below in connection with the electronic cigarette illustrated in FIG. 4. For example, the electronic pipe 100 may include the lithium battery 35, the printed circuit board 70, or other elements illustrated in FIG. 4.

Figure 4:
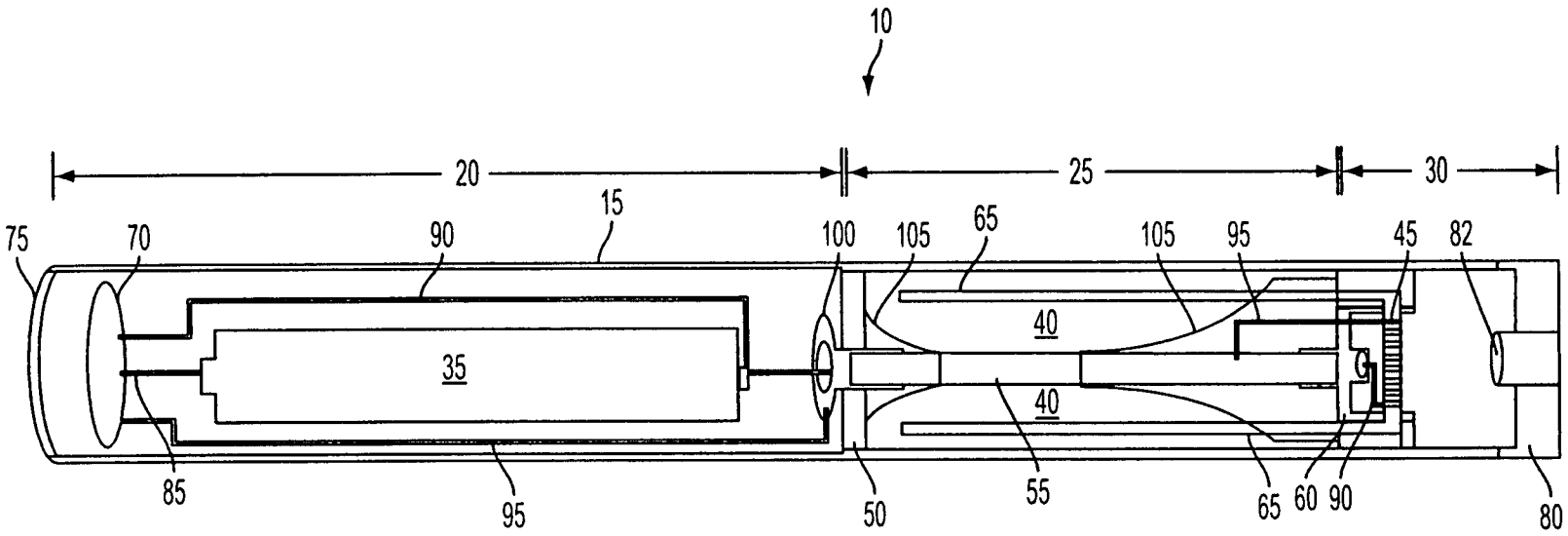
FIG. 4 is a cross-sectional view of an electronic cigarette that may provide elements and components for the electronic pipe.

Referring to FIG. 4, an electronic cigarette 10 is illustrated. The electronic cigarette 10 comprises a cylindrical casing, or tube 15 that may be constructed of stainless steel, plastic, or other materials. Within the cylindrical casing 15, a first chamber 20, a second chamber 25, and a third chamber 30 are formed, the three chambers located sequentially within the cylindrical casing 15. A battery 35 is located in the first chamber 20, a liquid, or fluid 40 is located in the second chamber 25, and a heating element 45 is located in the third chamber 30. In one embodiment, the liquid 40 contained in the electronic cigarette 10 comprises: glycol, nicotine, water based flavors of regular or menthol (or other desired flavors). The heating element 45 may be made of platinum wire, nickel chromium alloy or iron chromium aluminum alloy wire with a rare earth element.

The battery 35 may be lithium, but other materials and types of batteries may be employed, including disposable types. A first seal 50 forms a partition between the first 20 and second 25 chambers. The first seal 50 may be constructed of rubber, silicone, plastic or other materials. The first seal includes a hole or aperture in which a portion of a tube 55 is located. The tube 55 extends substantially the length of the second chamber 25 allowing passage of air from the first chamber 20 into the third chamber 30.

A second seal 60 forms a partition between the second 25 and third 30 chambers. In one embodiment, the second seal 60 comprises a ceramic material shaped substantially in a "T." The "leg" of the "T" comprises a hollow cylinder that receives one end of the tube 55 and the "top" of the "T" comprises two arms that form the seal between the second 25 and third 30 chambers, and may also hold, or fix the heating element 45 in position in the third chamber 30.

The electronic cigarette 10 also includes a cotton or other fiber material 65 that has a first segment in contact with the heating element 45, and a second segment located in the second chamber 25, so that the fiber material 65 can carry or transfer the fluid 40 from the second chamber 25 to the heating element 45. In one embodiment, the fiber material comprises a high-temperature fiberglass fabric, but other materials may be employed, such as cotton, high-temperature conduction oil cotton, or other materials. The fiber material 65 also may be positioned by the second seal 60 to aid in sealing the second chamber 25 from the third chamber 30.

An air pressure switch is located at a distal end of the first chamber 20 and may be mounted on, or separate from a printed circuit board 70. A light-emitting diode 75 (LED) is located adjacent to the printed circuit board 70, with the LED 75 forming an end-cap at one end of the electronic cigarette 10. A mouthpiece (not shown) may be located at the other end of the electronic cigarette 10, with the mouthpiece coupled to the end-cap 80 that includes a small aperture, or end-cap aperture 82 that allows passage of air from the third chamber 30 though the mouthpiece and into a user's mouth. The end-cap 80 may be made of silicone, plastic, metal or other materials.

The printed circuit board, or chip 70 includes the air pressure switch, which may be integral to the chip or may be a separate element that communicates with the chip. In one embodiment, the chip and air pressure switch comprise an electronic assembly that allows communication between the air pressure switch and the other components comprising the printed circuit board. For example, in one embodiment, the printed circuit board, or chip may comprise an embedded data processor connected via an internal bus to a read only memory containing the executable code for causing the microprocessor to perform the functions described herein. In another embodiment, the printed circuit board, or chip may comprise one or more electronic circuits that employ one or more switches to perform the functions described herein. As shown in FIG. 4, the printed circuit board, or chip 70 has three wires coupled to it, the anode wire 85, the cathode wire 90 and the air pressure switch wire 95. The anode wire 85 runs from the printed circuit board 70 to the anode side of the battery. The cathode wire 90 connects the printed circuit board 70 to the cathode side of the battery, and then passes through the first seal 50 and into tube 55 connecting to a first end of the heating element 45 by extending all the way through the tube 55. The air pressure switch wire 95 connects the air pressure switch to the second end of the heating element 45, by also passing through the first seal 50 and then into the tube 55.

Sealing member 100 may be coupled to the tube 55 to provide additional sealing to prevent passage of fluid 40 from the second compartment 25 into the first compartment 20. The sealing member 100 may comprise a cylindrical shape at one end that receives the tube 55 and a shoulder or flange at the other end that aids in sealing the hole or aperture in the first seal 50 seal.

In addition, two sealing tubes 105 are included to seal each end of the second chamber 25. As shown in FIG. 4, one sealing tube 105 contacts the first seal 50, with the other end contacting the entire perimeter, or circumference of tube 55 so that the area where the tube 55 engages with the first seal 50 is kept free of the fluid 40. Similarly, at the other end of the second chamber 25, a second sealing tube. 105 contacts the entire perimeter of tube 55 with a distal end enclosing the elements located at the end of the second chamber 25. However, the fiber material 65 extend through holes in the sealing tube 105 so that fluid 40 can pass along the fiber material 65 to the heating element 45. But, the air pressure switch wire 95, and cathode wire 90, as well as the end of the tube 55 that engages with the second seal 60 are kept free of the fluid 40. Optionally, cotton batting (not shown) may be positioned around the tube 55 and under, or within the two sealing tubes 105 to aid in sealing so that the fluid 40 does not reach either end of the tube 55, or the other areas sealed by the two sealing tubes 105. An air inlet (not shown), in the form of a hole or aperture, may be located in the external wall of the casing 15 allowing passage of ambient air into the first chamber 20.

The printed circuit board, or chip 70 in conjunction with the air pressure switch controls the function of the electronic cigarette 10. According to one embodiment, outside, or ambient air is drawn into the first chamber 20 through the air inlet (not shown). The air pressure switch senses the low pressure formed by a user "drawing" on the mouthpiece (not shown), and activates the heating element 45 by allowing electricity to flow from the battery to the heating element 45. The LED 75 also illuminates at this time. The air flows down the tube 55 and into the third chamber 30, where the heating element 45 has atomized, or vaporized some of the fluid 40 that is carried to the heating element 45 on the fiber material 65. The vaporized fluid mixes with the air, and passes though end-cap aperture 82 that allows passage of the mixture from the third chamber 30 though the mouthpiece and into a user's mouth. In one embodiment, the electronic cigarette 10 is disposable. During operation, if a user smokes for more than 5 seconds per puff the LED flashes two times then shuts off, or will flash ten times, which indicates the battery 35 is running low on stored power.

It is to be noticed that the term "comprising," used in the claims, should not be interpreted as being limitative to the means listed thereafter. Thus, the scope of the expression "a device comprising means A and B" should not be limited to devices consisting only of components A and B. It means that with respect to the present invention, the only relevant components of the device are A and B. Put differently, the terms "including", "comprising" and variations thereof mean "including but not limited to", unless expressly specified otherwise. Similarly, it is to be noticed that the term "coupled", also used in the claims, should not be interpreted as being limitative to direct connections only. Thus, the scope of the expression "a device A coupled to a device B" should not be limited to devices or systems wherein an output of device A is directly connected to an input of device B. It means that there exists a path between an output of A and an input of B which may be a path including other devices or means. The enumerated listing of items does not imply that any or all of the items are mutually exclusive, unless expressly specified otherwise. The terms "a", "an" and "the" mean "one or more", unless expressly specified otherwise. Elements of the invention that are in communication with each other need not be in continuous communication with each other, unless expressly specified otherwise. In addition, elements of the invention that are in communication with each other may communicate directly or indirectly through one or more other elements or other intermediaries.

Thus, it is seen that electronic pipe is provided. One skilled in the art will appreciate that the present invention can be practiced by other than the above-described embodiments, which are presented in this description for purposes of illustration and not of limitation. The specification and drawings are not intended to limit the exclusionary scope of this patent document. It is noted that various equivalents for the particular embodiments discussed in this description may practice the invention as well. That is, while the present invention has been described in conjunction with specific embodiments, it is evident that many alternatives, modifications, permutations and variations will become apparent to those of ordinary skill in the art in light of the foregoing description. Accordingly, it is intended that the present invention embrace all such alternatives, modifications and variations as fall within the scope of the appended claims. The fact that a product, process or method exhibits differences from one or more of the above-described exemplary embodiments does not mean that the product or process is outside the scope (literal scope and/or other legally-recognized scope) of the following claims.

What is claimed is:

1. An electronic pipe, comprising:

a first pipe section comprising a battery, an electronic module and a first connector element, the battery and first connector element both communicating with the electronic module;

a second pipe section structured to be removeably attachable to the first pipe section, the second pipe section comprising:

a mouthpiece receiver;

a combustible material reservoir located within the second pipe section, the combustible material reservoir including a passageway that communicates with the mouthpiece receiver;

an aperture located on a surface of the second pipe section, the aperture communicating with the combustible material reservoir so that a fluid exterior to the electronic pipe can pass into the aperture, through the combustible material reservoir and into the passageway that communicates with the mouthpiece receiver; and a second connector element structured to removeably couple to the first connector element, with both connector elements structured to transmit an electric current from the battery to a heating element located within the combustible material reservoir, the heating element initiating a combustion reaction in the combustible material reservoir.

2. The electronic pipe of claim 1, further comprising a light-emitting diode (LED) coupled to a distal end of the first pipe section, the LED communicating with the electronic module.

3. The electronic pipe of claim 1, further comprising a liquid crystal display (LCD) located on a surface of the first pipe section, the LCD communicating with the electronic module.

4. The electronic pipe of claim 1, further comprising a mouthpiece structured to be removeably attachable to the mouthpiece receiver.

5. The electronic pipe of claim 1, where the electronic module is selected from a group consisting of: a printed circuit board, an integrated circuit, a computer chip; a printed circuit board having an integrated circuit mounted thereon, and a memory module encoded with a program.

6. The electronic pipe of claim 1, further comprising a heating wire positioned in the combustible material reservoir, the heating wire communicating with the battery, the heating wire selected from a group consisting of: a platinum wire, a nickel chromium alloy wire, an iron chromium aluminum alloy wire, and a wire comprised of a rare earth element.

7. The electronic pipe of claim 1, where the battery is rechargeable.

8. An electronic pipe, comprising:

a first pipe section having a circular cross-section and comprising a battery, an electronic module and a first connector element located at a first distal end of the first pipe section, with the battery and first connector element both communicating with the electronic module; a light-emitting diode (LED) coupled to a second distal end of the first pipe module, the LED communicating with the electronic module;

a liquid crystal display (LCD) located on a surface of the first pipe module, the LCD communicating with the electronic module;

a second pipe section having a circular cross-section, and structured to be removeably attachable to the first pipe section, the second pipe section comprising:

a mouthpiece receiver;

a heating net receiver located within the second pipe section, the heating net receiver including a passageway that communicates with the mouthpiece receiver;

a heating net received in said heating net receiver;

an aperture located on a surface of the second pipe section, the aperture communicating with the heating net receiver so that a fluid exterior to the electronic pipe can pass into the aperture, through the heating net receiver and into the passageway that communicates with the mouthpiece receiver;

a second connector element structured to removeably couple to the first connector element, with both connector elements structured to transmit an electric current from the battery to a heating element located within the heating net receiver to heat said heating net, the heating element initiating a combustion reaction in the heating net; and a mouthpiece structured to be removeably attachable to the mouthpiece receiver.

9. The electronic pipe of claim 8, where both the first and second pipe section are constructed of a material selected from a group consisting of: a steel alloy, an aluminum alloy, a plastic, and a combination of an aluminum alloy and a plastic.

10. The electronic pipe of claim 8, further comprising a heating wire positioned in the heating net receiver, the heating wire communicating with the battery, the heating wire selected from a group consisting of: a platinum wire, a nickel chromium alloy wire, an iron chromium aluminum alloy wire, and a wire comprised of a rare earth element.

* * * * *